US006138385A

United States Patent [19]

Jungkind et al.

[11] Patent Number: 6,138,385

[45] Date of Patent: Oct. 31, 2000

[54] SHOE SOLE, AND SHOE WITH SUCH A SOLE

[75] Inventors: Roland Jungkind, Garmisch-Partenkirchen; Reinhold Sussmann, Scheinfeld; Horst Widmann, Schwaig, all of Germany

[73] Assignee: Puma Aktiengellschaft Rudolf Dassler Sport, Herzogenaurach, Germany

[21] Appl. No.: 08/737,323

[22] PCT Filed: Mar. 5, 1996

[86] PCT No.: PCT/DE96/00390

§ 371 Date: Feb. 27, 1998

§ 102(e) Date: Feb. 27, 1998

[87] PCT Pub. No.: WO96/28053

PCT Pub. Date: Sep. 19, 1996

[30] Foreign Application Priority Data

Mar. 9, 1995 [DE] Germany ..... 295 03 810 U

[51] Int. Cl.[7] ..... A43B 3/26

[52] U.S. Cl. ..... 36/97; 36/102; 36/31

[58] Field of Search ..... 36/97, 102, 103, 36/112, 31

[56] References Cited

U.S. PATENT DOCUMENTS

| | | | |
|---|---|---|---|
| 2,815,588 | 12/1957 | Ruane . | |
| 4,166,329 | 9/1979 | Herbig | 36/97 |
| 4,178,925 | 12/1979 | Hirt | 36/97 |
| 4,507,879 | 4/1985 | Dassler | 36/102 |
| 4,944,099 | 7/1990 | Davis . | |
| 5,029,575 | 7/1991 | Zhivotchenko et al. | 36/97 |
| 5,060,402 | 10/1991 | Rosen | 36/97 |
| 5,425,186 | 6/1995 | Hoyt . | |

FOREIGN PATENT DOCUMENTS

| | | | |
|---|---|---|---|
| 59317 | 10/1891 | Germany . | |
| 73629 | 8/1893 | Germany | 36/112 |
| 189777 | 10/1907 | Germany . | |
| 634858 | 3/1950 | United Kingdom | 36/97 |

*Primary Examiner*—Paul T. Sewell
*Assistant Examiner*—Jila Mohandesi
*Attorney, Agent, or Firm*—Nixon Peabody LLP; David S. Safran

[57] ABSTRACT

The aim of the invention is to design a sole (1), and a shoe with such a sole (1), so that the length of the sole (1) or of the upper attached to it can be easily adjusted, using adjustment means (11), to meet the needs of the wearer of the shoe. This is achieved by virtue of the act that a front thrust block (7) is fitted at the rear (5) of the front sole (2) and a rear thrust block (8) at the front (6) of the rear sole (3). The shoe is fitted with at least one adjustment means (11) which forms a force-locking connection with the two thrust blocks (7, 8), the jointed section (4) thus being adjustable by the adjustment means (11) to various lengths.

19 Claims, 3 Drawing Sheets

FIG. 7
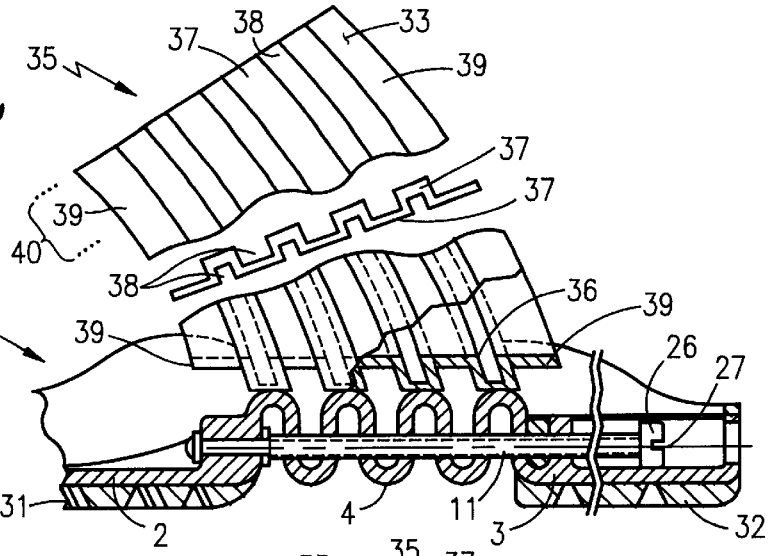
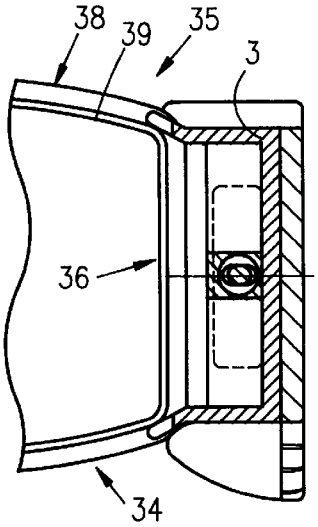
FIG. 9
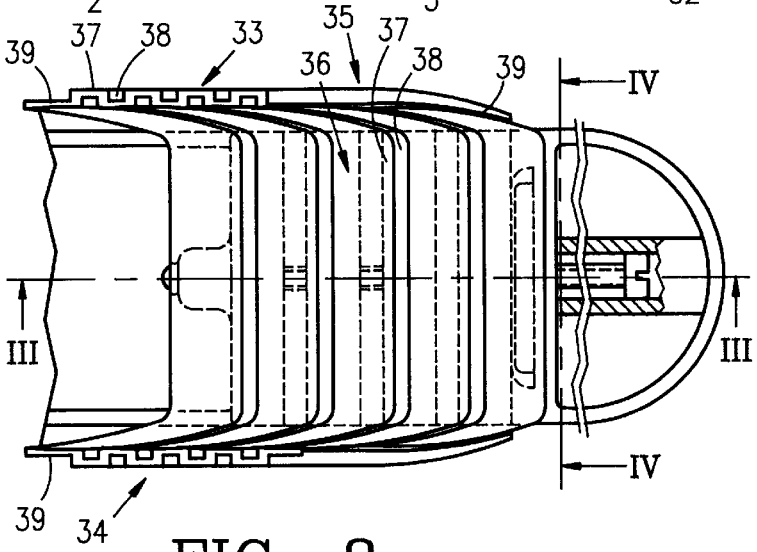
FIG. 8
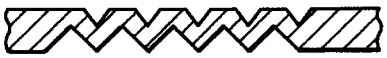
FIG. 10a
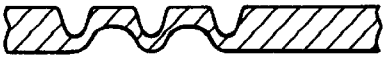
FIG. 10b
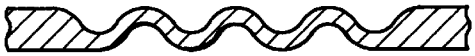
FIG. 10c
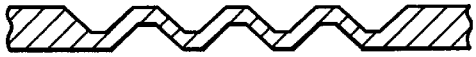
FIG. 10d
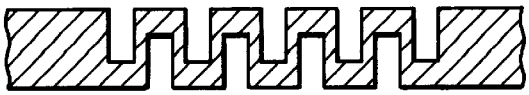
FIG. 10e
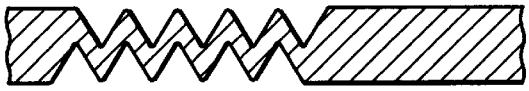
FIG. 10f

SHOE SOLE, AND SHOE WITH SUCH A SOLE

BACKGROUND OF THE INVENTION

1. Field of the Invention

This invention relates to a shoe sole having a jointed section that expandable in length in a jointed area between a front sole and a rear sole, and at least one adjustment means with a spindle running approximately in a direction of a longitudinal axis of the sole in such a way that, in one direction of rotation of spindle of the adjustment means, the front and rear sole are moved toward one another and in an opposite direction of rotation of the spindle of the adjustment means, the front and rear sole are moved away from one another.

2. Description of Related Art

A shoe sole of the type to which this invention is directed is known from U.S. Pat. No. 4,944,099.

The adjusting spindle projects over the rear edge of the heel. In the area of the rear heel wall, it has an annular groove into which a guide plate that is inserted into the heel wall engages. With the aid of the guide plate and the annular groove of the adjusting spindle, the spindle can be mounted rotatably and immovably in the heel wall. When the adjusting spindle rotates via a head that projects over the rear edge of the heel, the rear section of the front sole is drawn into the heel or pulled back out from the latter depending on the direction of rotation. As a result, the size of the shoe can be continuously adjusted.

When running, as is generally known, the heel is stressed at its lower edge with maximum step-down pressure. High stressing of the heel material therefore occurs in the area of the guide plate. As a result, the adjusting spindle that runs through the entire heel is subjected to extreme bending stress, especially in the rear area, when stepped on in this way. The jointed area of the front sole is not configured in an expandable manner in this sole design.

SUMMARY OF THE INVENTION

This invention is to achieve the object of further developing a shoe sole of the above-mentioned type in such a way that the heel material at the rear edge is no longer so heavily compression-stressed and no bending moment or only negligible bending moment is exerted on the adjusting spindle.

This object is achieved by the features of the invention described below.

According to the invention, from the inside the head of the adjusting spindle can rest virtually directly on the rear thrust block in the smallest adjustable shoe size, so that the heel is not penetrated by the adjusting spindle and works like a conventional heel. In the largest adjustable shoe size, the adjusting spindle projects a maximum of about ⅔ of the way to the rear into the heel. In this case, however, there is no great stress of the heel material in the area of the rear heel edge, so that the wear on the material is greatly reduced there compared to the configuration that is known from DE-PS 189777.

Additional advantageous details of the invention are described in more detail below based on the embodiments that are depicted in the drawings.

BRIEF DESCRIPTION OF THE DRAWINGS

FIG. 7 shows a side view of a sole section with attached or integrated lateral upper section along section III—III of FIG. 8, FIG. 8 shows a top view of the sole section according to FIG. 7, FIG. 9 shows a view along section IV—IV of FIG. 8, FIGS. 10*a* to 10*f* show possible cross-sectional shapes of to the jointed section

DETAILED DESCRIPTION OF THE PREFERRED EMBODIMENTS

Figure 1:
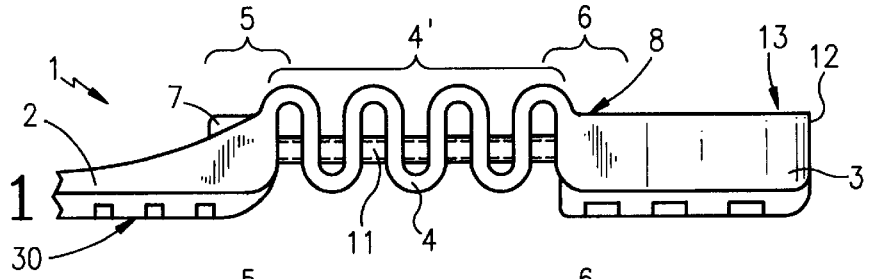
FIG. 1 shows a rear sole section with the jointed area viewed from the side, FIGS. 2–4 each show a side view along section I—I of FIG. 5.

In FIGS. 1 to 6, a shoe sole which consists of a front sole or of a front sole section 2, a rear sole or a rear sole section 3, and a jointed section 4, is referred to as 1. Jointed section 4 extends over or approximately over jointed area 4'.

Individual sole sections 2, 3, 4 can consist of a uniform, homogeneous component, e.g., a single shaped part or molded part, or jointed section 4 can be fastened to, on the one hand, rear end area 5 of front sole 2 and, on the other hand, to front area 6 of rear sole 3, e.g., sewn on and/or glued or—even using a material other than that of front and/or rear sole sections 2, 3—molded-on.

One thrust block 7 or 8 each is provided in end area 5 of front sole 2 as well as in front area 6 of rear sole 3, whereby in each case said thrust blocks form structural units with shoe sole 1 or with heels 2, 3 in question or are fastened to the latter, for example, glued, molded-on or in some other way connected to one another. Thrust blocks 7, 8 can be manufactured from a particularly more stable material than other shoe sole parts 2, 3, 4.

In rear thrust block 8, which is formed, for example, by a recess 9 in a block, a nut disk 10 or a web with a threaded hole is inserted. An adjustment means 11 that is designed as a threaded bolt is screwed into this threaded hole with its rear threaded section 11.1 from back wall 12 of heel part 13 or a heel through a recess 14 that is provided there or through a slot. As can be seen from FIG. 2, the head of adjustment means 11 projects with the smallest shoe size adjustment from thrust block 8 approximately ⅔ of the way into heel 3. With the largest adjustment of the shoe size, the head can rest on thrust block 8 and therefore virtually no longer projects into the heel. When stepped on, the heel is thus stressed in this state like a conventional heel.

End 15 of adjustment means 11 that projects forward engages into a blind hole 16 of front thrust block 7 that is open towards the rear and runs in the direction of adjustment means 11.

Jointed section 4 of the embodiment according to FIGS. 1 to 4 is formed by a wavy, folded web, whose wave crests 17 and wave troughs 18 run crosswise to longitudinal axis 19 of the sole, especially perpendicular or approximately perpendicular, to the latter. This shape is usually not formed by folding, however, but rather is produced in this shape directly, for example by an injection or injection-molding process.

Adjustment means 11 preferably runs in or approximately in the direction of longitudinal axis 19 of shoe sole 1. Adjustment means 11 is plugged through openings 20 of individual wall parts 21 of jointed section 4 that are formed by the folding.

Figure 2:
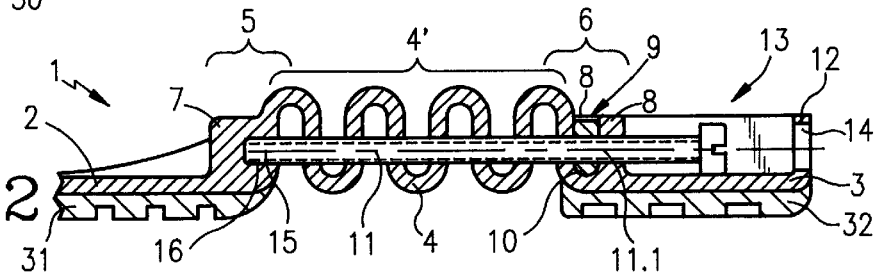

Sole sections 2, 3 and 4 preferably consist of elastically flexible or springy material. With the embodiment according to FIGS. 1 to 3, jointed section 4 is shaped in such a way that it occupies a minimal length, into which adjustment means 11 engages, for example without compression stress. FIGS. 1 and 2 show this position.

Figure 3:
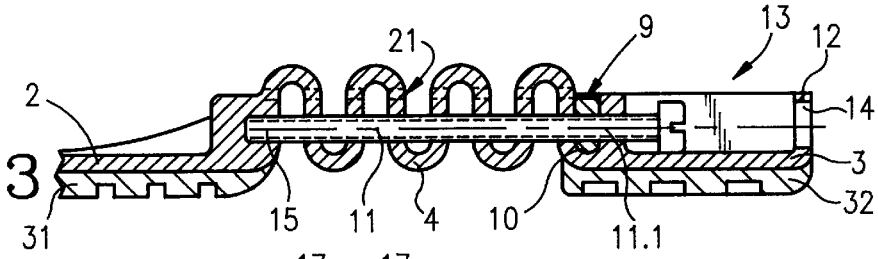

If adjustment means 11 is further screwed by rotation into nut disk 10, i.e., adjusted toward the left in the plane of the drawing, then free end 15 of adjustment means 11 presses against the bottom of blind hole 16 in thrust block 7. As a result, said thrust block 7 is moved away from thrust block 8, thereby causing jointed section 4 to expand. Thus, jointed area 4' is also extended, and the entire length of the shoe sole is enlarged. This enlarged case is depicted in FIG. 3.

By screwing adjustment means 11, for example, back into the starting position, jointed section 4 again occupies its original shape and position as a result of its material-related return moment.

In this way, a shoe sole 1 and a shoe that is provided with the latter can be adjusted very simply and quickly to various sizes and/or other needs of the foot.

Figure 4:
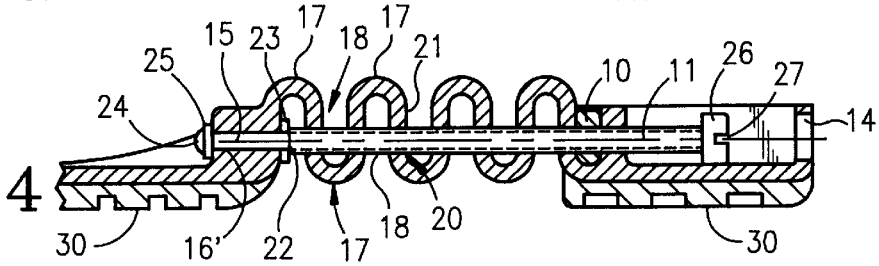

In the embodiment depicted in FIG. 4, free end 15 of adjustment means 11 is plugged through a hole 16' of thrust block 7. In hole 16', it is mounted rotatably but axially immovably in thrust block 7 by an inner pressure disk 23 that rests on a heel 22 of adjustment means 11 and a tension disk 25 that is applied outside and secured by a rivet head 24. In this way, during rotation of adjustment means 11, the length of jointed section 4 or of jointed area 4' can be shortened or lengthened depending on the selected direction of rotation.

By leaving out pressure disk 23, a design can be obtained in which jointed section 4 is stressed only in pulling and thus only in the direction of shortening. Return is again ensured by the resilience of the material, when adjustment means 11 is rotated in the direction of the lengthening of jointed section 4.

Figures 5, 6:
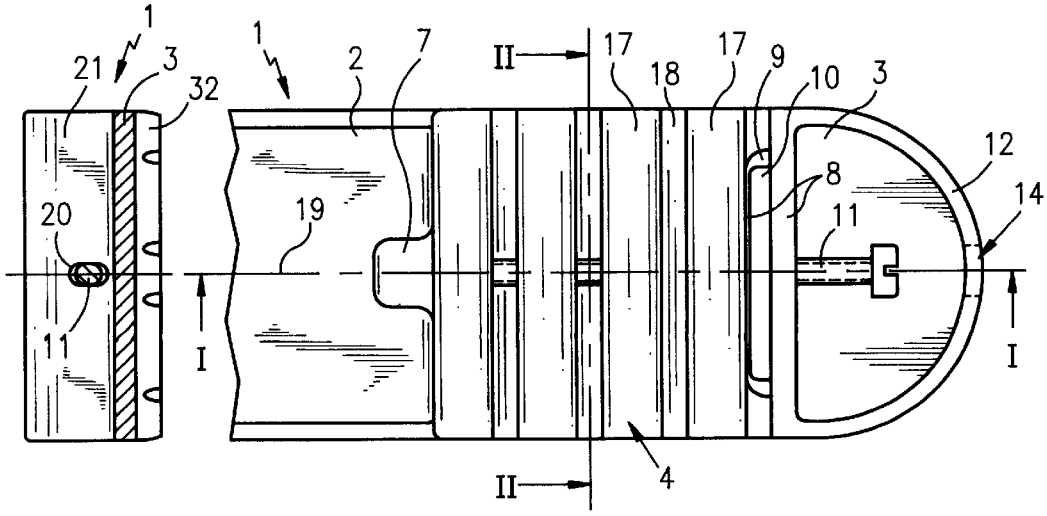
FIG. 5 shows a top view of the sole section of FIGS. 1 to 4.
FIG. 6 shows a view along section II—II of FIG. 5.

As depicted in FIG. 6, openings 20 in wall parts 21 are preferred as longitudinal holes that extend from above downward. As a result, the material of jointed section 4 can yield upward and downward during running. As a result, damage or premature wear of jointed section 4 is avoided.

According to an advantageous embodiment of the invention, one threaded guide each, as described and shown based on FIGS. 1 to 3, can be provided in both thrust blocks 7 and 8. In this case, the two threads are made to turn opposite one another, so that when adjustment means 11 is rotated in one direction, two thrust blocks 7, 8 are moved respectively in directions that are opposite to one another. As a result, a compression or expansion effect can also be achieved in a simple way, and thus the shortening or lengthening of the shoe can be adjusted.

To be able to adjust adjustment means 11, end area 11.1 is provided with a head 26 and a slot 27 that is made on its front side. As a result, adjustment means 11 can be adjusted through recess 14 with a tool, for example, a screwdriver. Instead of slot 27, a cross slot or an inside polygon can also be provided. Head 26 can also have an outside polygon or adjustment means 11 can be designed as a whole or at least in end area 11.1 as a polygon.

Figure 17:
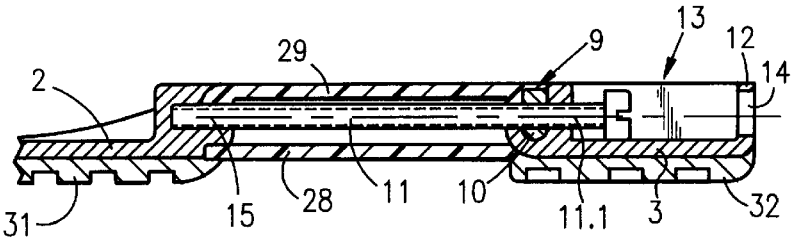
FIG. 17 shows an embodiment with elastically expansible diaphragms or plates.

Instead of the corrugated jointed section 4 that is depicted in FIGS. 1 to 6, an elastically expansible diaphragm or plate 28, 29, as shown in FIG. 17, optionally can be provided in addition into section 4, under adjustment means 11 or under jointed section 4, optionally in addition over section 4. In FIG. 17, section 4 has been omitted for clarity.

Jointed section 4 and/or lower diaphragm 28 preferably is or are designed and arranged deeply enough recessed relative to running surface 30 of the sole that when the foot steps on even ground, these parts have no contact with the ground. The indentation is suitably selected so that the distance from the ground without stressing is about 1 mm to 8 mm, preferably about 2 mm to 5 mm.

Shoe sole 1 together with running surface 30 can consist of a single homogeneous shaped part or molded part. Running surface 30 can also be shaped, however, by molding-on or gluing a sole plate 31 or heel plate 32, optionally also made of more abrasion-resistant material than that of sole sections 2, 3, 4.

According to another advantageous configuration of the invention, one upper section 33, 34 each that projects upward and preferably is tilted forward is attached, e.g., molded-on, glued, sewed-on or welded, on both sides, according to FIGS. 7 to 9 in jointed area 4'. Upper sections 33, 34 can optionally be the Leg of a U-shaped molded part 35, whose base 36 extends above jointed area 4' or jointed section 4. Molded part 35 can be molded-on there or glued to jointed section 4 or connected to it in some other way.

Upper sections 33, 34 and optionally also base 36 of molded part 35 consist of an elastically flexible and expandable material, so that lengthwise expansion or shortening of jointed section 4 can be done at the same time. Instead of or in addition to the design of elastically flexible material, upper sections 33, 34 and base 36 can be made similarly or exactly the same way as jointed section 4, whereby, e.g., wave crests 37 and wave troughs 38 in the case of upper sections 33, 34 run upward and in a corresponding fashion in the case of base 36, as in jointed section 4.

Various other designs of jointed section 4 are depicted diagrammatically in FIGS. 10*a* to 10*f*. The undulation is generally made more narrow than depicted, so that a large range is possible for varying the length without stressing the material greatly.

Upper sections 33, 34 and optionally also base 36 preferably have edge strips 39, to which the upper material of a shoe can be sewn, glued, welded or connected in some other way.

Means for guiding and holding a tightening element, e.g. a shoelace, can be attached or molded-on to upper sections 33, 34, preferably in upper end area 40. These can be hooks, loops, looping elements, channels, or the like.

In a way known in the art, a shoe that is equipped with shoe sole 1 according to the invention has an insole and/or midsole and/or a slipsole or inner sole 5. The upper material is rigidly connected, e.g., glued or molded-on, to shoe sole 1. In jointed section 4' the upper material is provided with lateral recesses, in which upper sections 33, 34 can be placed and can be rigidly connected with their edge strips 39 to the upper material. Above or laterally open in the instep area of the shoe and on the material edges, the upper material is equipped with fastening and/or holding elements for a strap. These parts are suitably matched to the type and arrangement of those on upper parts 33, 34.

Adjustment means 11 used in this invention is or are designed in such a way that the length of the sole can be changed by 1 cm up to 4 cm, especially about 1 cm to 3 cm. Adjustment means 11 can preferably be adjusted directly from back 12 of heel part 13 or with a tool.

In the embodiments depicted in FIGS. 11 to 16, a pressure spring 41 is provided in jointed section 4, which can be adjusted with the aid of adjustment means 11 on varying prestressing, by jointed section 4 being shortened by screwing in adjustment means 11. In this design, from the inside head 26 of adjustment means 11 always rests on rear thrust block 8. Therefore, no section of adjustment means 11 projects into heel 3. Heel 3 is therefore stressed when used as a conventional heel.

Figure 11:
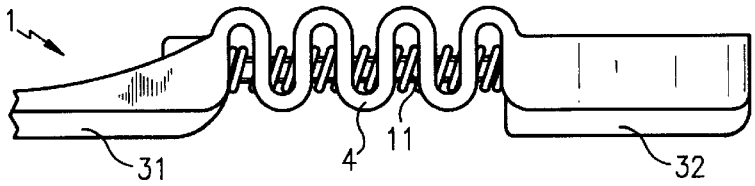
FIGS. 11 to 16 show embodiments with a pressure spring or pressure springs provided in the jointed section.
Figure 12:
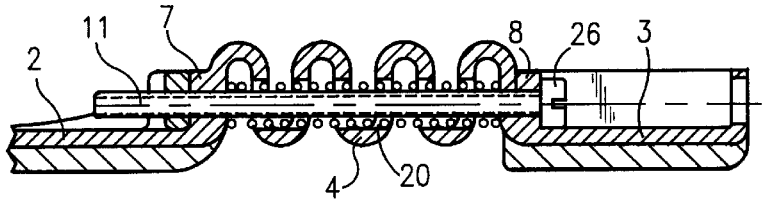
Figure 13:
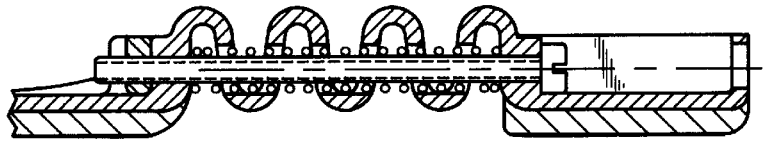

According to FIGS. 11 to 13, pressure spring 41, which is preferably designed as a helical spring, is inserted through widened openings 20 of jointed section 4. It is moved via adjustment means 11 and secured by the latter against lateral yielding. Pressure spring 41 is supported from the inside on thrust blocks 7, 8. FIGS. 11 and 12 show the adjustment in the case of shortened jointed section 4. If adjustment means 11 is unscrewed, pressure spring 41 presses jointed sections 4 apart into a length that is limited by adjustment means 11. As is evident, in this connection adjustment means 11 is always stressed only in tension. As a result, its cross-section relative to the above-described designs can be made significantly thinner. This makes it possible to design adjustment means 11 in such a way that it can follow the bending movements of jointed section 4.

Instead of pressure spring 41 that is arranged over adjustment means 11—or in addition to the latter—one or more pressure spring(s) 41 can be arranged laterally adjacent to adjustment means 11 in jointed section 4. Such a design is depicted in FIGS. 14 to 16.

Figure 14:
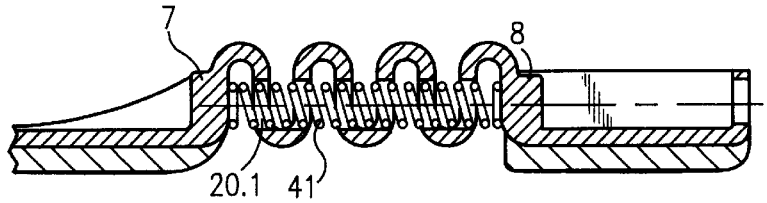

In FIG. 14, a pressure spring 41 is arranged adjacent to adjustment means 11, by jointed section 4, adjacent to adjustment means 11, having additional openings 20.1, in which pressure spring 41 is inserted and supported on thrust blocks 7, 8. Pressure spring 41 can be inserted in such a way that jointed section 4 is bent upward in the last link, and then pressure spring 41 is inserted and then jointed section 4 is returned to its normal position under the action of its inherent elasticity. The visualization shows the compressed adjustment, i.e., a "small shoe size."

Figure 15:
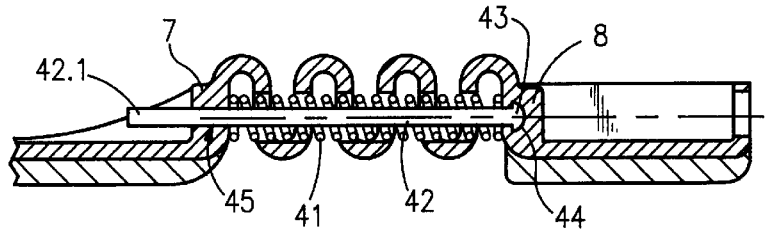
Figure 16:
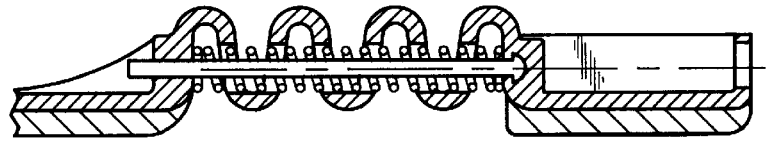

In the embodiment depicted in FIGS. 15 and 16, pressure spring 41 is penetrated by a rod 42, especially a springy elastic rod. This prevents pressure spring 41 from yielding, mainly in the heavily stressed state. Rod 42 is rigidly held in thrust block 8, by being inserted with a head 43 into a corresponding recess 44 of thrust block 8. In other thrust block 7, rod end 42.1 is mounted movably in a hole 45. FIG. 15 shows the compressed state of pressure spring 41, and FIG. 16 shows a more relaxed state of pressure spring 41.

Instead of a rod 42, a sleeve that surrounds pressure spring 41 can also be provided, which can take part in the expansions. For example, this can be a corrugated tube or these can also be tube sections that can move into one another like a telescope.

What is claimed is:

1. Shoe sole having a jointed section that is expandable in length in a jointed area between a flexible front sole and a flexible rear sole, and at least one adjustment means, each adjustment means comprising an adjusting spindle running approximately in a direction of a longitudinal axis of the sole between a front thrust block that is provided in rear end area of the front sole and a rear thrust block that is provided in the rear sole in such a way that, in one direction of rotation of spindle of the adjustment means, the front and rear sole are moved toward one another, and in an opposite direction of rotation of the spindle of the adjustment means, the front and rear sole are moved away from one another; wherein each rear thrust block is located exclusively in a front area of the rear sole; and wherein the jointed section of the shoe sole is provided between the front and rear thrust blocks.

2. Shoe sole according to claim 1, wherein the spindle of said at least one adjustment means is rotatable in both thrust blocks by a threaded connection in each of the thrust blocks and is held in a lengthwise adjustable manner, the screw threads of the thrust blocks turning in opposite directions relative to one another.

3. Shoe sole according to claim 1, wherein said at least one adjustment means extends at most along about ⅔ of the length of the rear sole toward the rear; and wherein the sole has an opening through which said at least one adjustment means is externally adjustable with a tool.

4. Shoe sole according to claim 3, wherein said at least one adjustment means has a head with one of a slot, cross slot, polygonal recess, and polygonal projection that is actuatable by said tool from outside of the sole.

5. Shoe sole according to claim 1, wherein one of a screw thread and nut part is provided in one of the thrust blocks; wherein the spindle of the adjustment means is provided, at least at one end area thereof, with a matching screw thread; and wherein an opposite end area of the spindle is fixed in the other thrust block.

6. Shoe sole according to claim 1, wherein the jointed section has one of a wavy, zig-zag and meander shape, with crests and troughs that run crosswise relative to the longitudinal axis of the sole.

7. Shoe sole according to claim 6, wherein the jointed section is made of a hard-elastic, springy, flexible material.

8. Shoe sole according to claim 1, wherein said at least one adjustment means is provided with one of an elastically expandable diaphragm and plate that ends below the sole.

9. Shoe sole according to claim 1, wherein said at least one adjustment means is provided with one of an elastically expandable diaphragm and plate that ends above the sole.

10. Shoe sole according to claim 1, wherein upper sections that project laterally upward in the jointed area are provided, and said upper sections being made of a material that is expandable and contractable corresponding to adjustment of the length of the jointed area.

11. Shoe sole according to claim 10, wherein the upper sections form a leg of a U-shaped molded part which has a base that is fastened to the jointed area.

12. Shoe sole according to claim 10, wherein the upper sections have essentially the same cross-sectional shape as the jointed area.

13. Shoe sole according to claim 1, wherein the upper sections extend in an obliquely forward direction from the jointed area.

14. Shoe sole according to claim 1, wherein the upper sections have edge strips with which they are rigidly connectable to material of an upper of a shoe.

15. Shoe sole according to claim 1, wherein the jointed area is penetrated by at least one pressure spring which rests on the thrust blocks.

16. Shoe sole according to claim 15, wherein the at least one pressure spring surrounds the spindle of the adjustment means.

17. Shoe sole according to claim 15, wherein at least one pressure spring is provided on at least one side of the spindle of the adjustment means.

18. Shoe sole according to claim 17, wherein the at least one pressure spring is penetrated by a rod which is rigidly held at one end in one of the thrust blocks and is movably mounted in the other of the thrust blocks.

19. Shoe comprising an upper and a shoe sole, said shoe sole having a jointed section that expandable in length in a jointed area between a flexible front sole and a flexible rear sole, and at least one adjustment means, each adjustment means comprising an adjusting spindle running approximately in a direction of a longitudinal axis of the sole between a front thrust block that is provided in a rear end area of the front sole and a rear thrust block that is provided in the rear sole in such a way that, in one direction of rotation of spindle of the adjustment means, the front and rear sole are moved toward one another, and in an opposite direction of rotation of the spindle of the adjustment means, the front and rear sole are moved away from one another; wherein each rear thrust block is located exclusively in a front area of the rear sole; and wherein the jointed section of the shoe sole is provided between the front and rear thrust blocks; wherein the upper is rigidly connected to the sole; wherein at least one of an insole and a midsole are provided; wherein material of the upper is cut out in the jointed area and is rigidly connected there to inserted expansible upper sections which are constructed in a manner which is similar or the same as the jointed section of the shoe sole.

* * * * *